United States Patent [19]

Brown

[11] 4,013,008

[45] Mar. 22, 1977

[54] METHODS AND SOLUTIONS FOR IMPROVEMENT OF OFFSET PRINTING

[76] Inventor: Dorvin Brown, 2925 Sinbad Trail, Farmers Branch, Tex. 75234

[22] Filed: Mar. 17, 1975

[21] Appl. No.: 558,667

[52] U.S. Cl. ..... 101/451; 106/2

[51] Int. Cl.[2] ..... B41N 3/08; B41M 1/02

[58] Field of Search ..... 106/2; 101/147, 451, 101/462, 465, 473; 148/6.14; 96/33

[56] References Cited

UNITED STATES PATENTS

| | | | |
|---|---|---|---|
| 2,441,653 | 5/1948 | VanDussen, Jr. | 96/33 X |
| 3,354,824 | 11/1967 | Griffith et al. | 101/451 |
| 3,394,653 | 7/1968 | Riesberg | 101/451 |
| 3,696,746 | 10/1972 | Harper | 101/465 |
| 3,764,353 | 10/1973 | Shimizu et al. | 106/2 |
| 3,775,135 | 11/1973 | Harper | 106/2 |

*Primary Examiner*—Theodore Morris
*Attorney, Agent, or Firm*—Thomas L. Cantrell; Joseph H. Schley

[57] ABSTRACT

Disclosed are the uses of polyphosphate solutions as fountain solutions in the dampener roll systems of offset presses and as rub-up solutions for preparing offset plates for storage without corrosion. In the fountain solution application of the invention, the polyphosphate concentration may run from about 0.6 g/l to about 42 g/l; in the plate storage application of the invention it may run from about 6 g/l to about 66 g/l. Particular polyphosphates which are useful in the invention include sodium tripolyphosphate, sodium hexametaphosphate and aminomethylenephosphonate.

3 Claims, No Drawings

METHODS AND SOLUTIONS FOR IMPROVEMENT OF OFFSET PRINTING

BACKGROUND OF THE INVENTION

In offset printing, the printing plate is generally made of aluminum or stainless steel in thin sheet form. The plates are treated photographically or otherwise to form greasy image regions thereon. The non-image portion of the plate is essentially bare metal. The printing plates are bound and tightly clamped around a cylinder generally termed a "printing cylinder". In use, the plate is "dampened" by applying, through a dampener roller or other dampener system, a thin sheet of water to the plate with each revolution of the printing cylinder. Greasy inks are then applied to the plate, usually by means of a roller in contact with the printing cyclinder. The greasy ink is attracted to the greasy image regions of the plate, and is repelled by the water-sheeted bare metal portions of the plate. Similarly, the water applied to dampen the plate is attracted to and sheets over the bare metal portions thereof but is repelled by the greasy image portions thereof.

The dampening water discussed above is normally actually a solution, commonly termed a "fountain solution" because it is carried on the press in a fountain pan, and is not simply water but a solution with additives therein designed to increase its effectiveness. The most common fountain solutions in general use contain small amounts of gum arabic (acacia), and chromic acid or phosphoric acid. Such solutions are often termed "gum and etch" solutions. In many instances alcohol, usually isopropyl alcohol, is included in the fountain solution to improve the wetting qualities.

The functions which must be performed by a fountain solution include thoroughly and uniformly wetting the bare metal portion of the plate while at the same time not wetting the greasy image portion of the plate, keeping the plate clean during the press run, and dissolving any dirt, especially grease-attracting dirt, which finds its way on to the bare metal portions of the plate. If these functions are not performed effectively, the result is a splotchy, dirty-appearing blemished background in the printed product. If the printed product is not satisfactory, paper, ink, and press time are thus wasted and costs are increased.

The sources of dirt finding its way on to the plates include the ink and paper employed in the press, and the naturally dirty atmosphere of a pressroom. Furthermore, the plate operates in an inherently corrosive environment since it is repeatedly coated with water and then wiped clean and exposed to the atmosphere in the course of printing operations. Stainless steel, and to a lesser extent aluminum, are commonly considered corrosion resistant, but in the severe application of offset printing operations, they are both actually quite susceptible to corrosion.

The function of the acid in the conventional gum and etch solutions is to eat away spots of corrosion on the plates, and to dissolve other dirt. The function of the gum arabic is to supply a thin unobjectionable protective coating to the plate. The function of the alcohol, as noted above, is to improve the wetting qualities of the solution.

Conventional gum and etch solutions present a number of problems. If the acid component is not carefully controlled, the material of the plate, as well as corrosion spots, may be dissolved to some extent, thus roughening the plate and causing the very blotchiness which the fountain solution is supposed to prevent. In addition, the acid component may attack the greasy image portion of the plate which also decreases the quality of the printed product. Gum arabic is a natural product and its quality and functional properties naturally vary from lot to lot in unpredictable manners, making continual experimentation at the press necessary to produce a satisfactory fountain solution for operations. Futhermore, since gum arabic is a natural product, its supply and its price vary objectionably. In particular, the price has increased several fold in recent times, thus pushing up printing costs undesirably.

Another problem that occurs in offset printing operations is that of storage of printing plates prior to and between press runs. The plates are normally removed from the press if they are not going to be used in the very next press run. On the other hand, they may be stored overnight or over a weekend by being left on the press. In any event, the plates are inherently very sensitive to corrosion and collection of dirt from the press room atmosphere during storage. Corroded and dirty plates are sometimes rendered unusable, and must be replaced. In addition, plates taken out of storage often require considerable rehabilitation work to remove corrosion and dirt before they can be put back on the presses. Furthermore, when put back on the presses, such plates often require some tinkering with and adjusting of fountain solutions, etc., before they can be made to print in a satisfactory manner. All of such work is time consuming and costly.

It is customary to prepare plates for storage by applying a rub-up solution similar in composition to fountain solution discussed above, but normally somewhat more concentrated. Other gum arabic based formulations are also used. The object of such rub-ups is to apply a thin protective coating of gum arabic to the plate. Such a coating is intended to prevent corrosion and to shield the bare metal from ambient dirt.

SUMMARY OF THE INVENTION

In accordance with the present invention, offset printing is improved by utilizing fountain solutions and/or storage rub-up solutions containing polyphosphates. In particular, solutions containing sodium tripolyphosphate, sodium hexametaphosphate and/or aminomethylenephosphonate, or blends of these materials, may be used.

In accordance with the fountain solution aspect of the invention, the polyphosphate solution is preferably used as a direct replacement for the prior art gum and etch solution. It has been found to work well with the various dampener systems commonly employed on offset presses. While preferred concentrations and formulations of polyphosphate solutions are set out in the detailed description that follows, it should be noted that an advantage of the invention is that the solutions are relatively non-critical with respect to concentration and formulation, and hence quite easy for a pressman to manage. That is to say, the solutions of the invention used in accordance with its method aspects do not require constant attention and constant adjustment to produce good results, as do the gum and etch solutions of the prior art. On the high concentration side of the concentration ranges, a main criterion is to avoid extravagant wastage of chemicals. No substantial deterioration in performance results from increasing the concentration of chemicals to a non-economic level. On the low concentration side of the concentration range there is also a degree of flexibility. With new plates which are clean and corrosion free, as little as 0.6 g/l of polyphosphate may be employed, if the pressman is willing to pay very close attention to the run and make adjustments as necessary if trouble shows up. On the other hand by using moderately larger amounts, good assurance of satisfactory results can be had.

Similar considerations apply in accordance with the plate storage aspect of the invention. As will appear below, relatively highly concentrated polyphosphate solutions provide very good corrosion protection, but so do solutions of more moderate concentration. Thus, on the high concentration side of the range, a main criterion is avoidance of wastage of chemicals. Very dilute solutions may be used with plates which are in basically good condition already, to good effect. On the low concentration range side, sufficient chemical should be employed to eliminate uncertainty that protection will be obtained.

With the foregoing discussion in mind, it can be stated that in the fountain solution application of the invention, the polyphosphate concentration may run from about 0.6 g/l to about 42 g/l; in the plate storage application of the invention, it may run from about 6 g/l to about 66 g/l.

DESCRIPTION OF THE PREFERRED EMBODIMENTS AND EXAMPLES

A preferred solution formulated in accordance with the present invention has the following composition:

EXAMPLE 1

Example 1

| Component | Volume Per Cent |
|---|---|
| Sodium tripolyphosphate | 4.3 |
| Sodium hexamethaphosphate | 21.5 |
| Aminomethylenephosphonate | 0.8 |
| Water | 73.4 |

This formulation is a suitable concentrate for dilution at the point of use for employment as a fountain solution. It is preferred that the formulation of Example 1 be used at a diluted concentration of 2 ounces per gallon (about 1 gram per liter of polyphosphate material) as a fountain solution. Depending upon operating conditions, the concentrate of Example 1 gives satisfactory results in fountain solutions at dilutions between about 0.3 oz. per gallon and about 3 ozs. per gallon (about 0.6 g/l to about 3 g/l polyphosphate concentration). Even higher concentrations may be employed, but the improvement in quality attained by further increases in concentrations not ordinarily economically justifiable.

For preparing plates for storage, it is preferred that the solution of Example 1 be employed without dilution.

EXAMPLE 2

The concentrate of Example 1 was diluted for use as a fountain solution at a concentration of 2 ozs. per gallon. It was placed in the fountain pan of a 38 inch Harris Web press equipped with a conventional dampening system. The plates employed were deep-etch aluminum. A four-color catalogue job was printed on both sides of 45-pound coated paper using heat-set inks. A total of 1,049,000 impressions was run. Five of the eight original plates involved in the run lasted throughout the run and were in excellent condition at the end of the run. Two plates failed mechanically at about 250,000 impressions (they cracked at the cylinder gap), said failures not being attributable to the fountain solution, and one plate was replaced because of mechanical wear after about 625,000 impressions, again for reasons independent of the fountain solution. Throughout the press run the quality of the printed product was excellent and uniform.

EXAMPLE 3

Aminomethylenephosphonate at a concentration of about 4.8 g/l was employed as a fountain solution on a Web press with a conventional dampener system. A press run, utilizing aluminum based plates, of 60,000 impressions was made with excellent and uniform quality.

EXAMPLE 4

Aminomethylenephosphonate at a concentration of about 5 g/l was used in a fountain solution which also contained 20% (approximately) isopropyl alcohol. This fountain solution was employed in a 38 inch two-color Harris sheet-fed press equipped with a Dahlgren dampener system. A press run was made using a single color (brown) on an uncoated paper. The plates employed were aluminum-based. The length of the press run was 15,000 impressions on each side. Results were excellent.

EXAMPLE 5

Sodium hexametaphosphate at a concentration of about 7 g/l was used in the fountain pan of a 38 inch Harris Webb press equipped with Dahlgren dampening system. A series of press runs totaling in the aggregate 239,000 impressions was made using newsprint black ink and uncoated paper. Results were excellent; a slight fuzziness encountered after about the first 30,000 impressions was cured by cleaning the metering roll of the dampening system, and increasing the delivery rate of fountain solution to the plate somewhat. It was noted that on start-up, the non-image area of the plate would ink up momentarily but that this condition cleared up very quickly and with little wastage of paper and ink.

EXAMPLE 6

Sodium hexametaphosphate at a concentration of about 14 g/l was employed in the fountain pans of a four-color 38 inch Webb fed press equipped with a Dahlgren dampening system. The fountain solutions also contained approximately 17% isopropyl alcohol. A four-color press run on both sides of 60 pound coated paper was made, employing heat-set ink. The results were generally very good; occasionally the ink rollers of the red and yellow units stripped for short periods of time.

EXAMPLE 7

Sodium hexametaphosphate at a concentration of about 1.75 g/l was used in the fountain pans of a four-color 38 inch Webb press having a Dahlgren dampening system. The fountain solutions also contained approximately 17% isopropyl alcohol. A four-color press run on both sides of 60-pound coated paper was made with a total of 152,000 impressions. Results were excellent; the plates stayed clean throughout the run. On the following day an additional run of 76,000 impressions was made from the same plates with the same fountain solutions, and excellent results were obtained.

EXAMPLE 8

A mixture of sodium tripolyphosphate and sodium hexametaphosphate (approximate ratio 1 to 5 by weight) was employed at a concentration of about 8.2 g/l in a fountain solution for a press run employing black ink on 38-pound newsprint. Aluminum-based plates were employed. After a medium length press run, the plates were left on the press during a Sunday shutdown. An additional 1500 impressions were run the following Monday without any maintenance being done on the plates. Results on the second run after shutdown were excellent. The plates contained no scum or sensitive spots.

EXAMPLE 9

The sodium tripolyphosphate - sodium hexametaphosphate mixture of Example 8 was used in a fountain solution at a concentration of approximately 10.9 g/l in a Webb press to print on newsprint of the kind employed in weekly high-circulation magazines. Four successive press runs totaling in the aggregate 218,000 impressions were made, using aluminum based plates. The results throughout the press runs were excellent and uniform.

EXAMPLE 10

In a school work book cover printing job being run on a 38 inch two-color Harris sheet-fed press equipped with a Dahlgren dampening system, trouble was encountered with the plates. The covers were to be solid red with five lines or stripes reversed out of the solid color. The difficulty was that the reversed areas could not be kept open without washing out the solid areas. Conventional cleaning of the plates did not cure the problem. The plate was then cleaned and coated with a solution containing the mixture of sodium tripolyphosphate and sodium hexametaphosphate at a concentration of approximately 5.4 g/l. The same solution was then placed in the fountain pan of the press. These steps cured the problem and a successful press run of 1,000 impressions was made.

EXAMPLE 11

A 38 inch Harris M 1,000 Webb press equipped with a standard dampening system was used with aluminum-based plates to print on 38-pound newsprint in a press run of 90,000 impressions. The material to be printed had two full-page "solids" with ahalf-tone figure in the middle of the solid. The sodium tripolyphosphate — sodium hexametaphosphate mixture of Example 8 was employed at a relatively high concentration of 42.2 g/l as a fountain solution in an effort to keep the half-tone figure clean and open, notwithstanding the heavy inking necessary to successfully print the solid areas of the material. The run was successful; the half-tone stayed clean and open throughout the run and the solid area printed successfully.

EXAMPLE 12

After use, two plates which had had 87,000 impressions taken from them onto newsprint by the offset process were coated with a solution containing approximately 13.9 grams/liter of sodium hexametaphosphate after being cleaned. They were then stored in the press room for 15 days. At the end of the storage time, the plates were wiped with 6% phosphoric acid and cleaned up very well for use.

EXAMPLE 13

A solution containing approximately 6.9 grams/liter of sodium hexametaphosphate was used to coat a variety of types of offset plates for storage for a 2-week period. Included in the types of plates were aluminum based plates, copperized aluminum deep-etched plates, bimetal plates with a stainless steel base, bimetal plates with an aluminum base and others. None of the plates oxidized; all were good and performed well when returned to the presses.

EXAMPLE 14

A mixture of sodium tripolyphosphate and sodium hexametaphosphate of the kind employed in Example 8 above was used at concentrations of 6.6 and 66.4 g/l to coat for storage a copperized aluminum plate. The dilute solution was employed to cover one-half of the plate and the concentrated solution was employed to coat the other half of the plate. The plate was then stored for 25 days and then was cleaned with water and a rub-up ink was applied to locate areas of oxidation. No oxidation was encountered and the plate performed excellently when put back into use.

From the foregoing, it can be seen that polyphosphate solutions, over a wide range of concentrations, are effective in fountain solutions and in storage coating solutions in the offset printing art.

What is claimed is:

1. A method of offset printing with a metal printing plate of the kind which is susceptible to corrosion and which tends to accumulate dirt in the non-image regions thereof, comprising dampening the surface of said plate in the non-image regions thereof with an aqueous polyphosphate solution containing polyphosphate in an amount at least equal to about 0.6 g/l prior to inking said plate and taking an impression therefrom, in which the aqueous polyphosphate solution consists essentially of a concentrate consisting essentially of:

| | Volume Per Cent |
|---|---|
| Sodium tripolyphosphate | 4.3 |
| Sodium hexametaphosphate | 21.5 |
| Aminomethylenephosphonate | 0.8 |
| Water | 73.4 |

diluted to a use concentration between about 0.6 g/l and about 3 g/l.

2. A method of offset printing with a metal printing plate of the kind which is susceptible to corrosion and which tends to accumulate dirt in the non-image regions thereof, comprising coating said plate with an aqueous polyphosphate solution containing polyphosphate in an amount between about 6 g/l and about 66 g/l, storing the coated plate until needed for use, and rinsing said stored coated plate after storage but prior to use, in which the aqueous polyphosphate solution consists essentially of a concentrate consisting essentially of:

| | Volume Per Cent |
|---|---|
| Sodium tripolyphosphate | 4.3 |
| Sodium hexametaphosphate | 21.5 |

-continued

| | Volume Per Cent |
|---|---|
| Aminomethylenephosphonate | 0.8 |
| Water | 73.4 |

3. A concentrate for use in fountain solutions and plate storage solutions consisting essentially of:

| | Volume Per Cent |
|---|---|
| Sodium tripolyphosphate | 4.3 |
| Sodium hexametaphosphate | 21.5 |
| Aminomethylenephosphonate | 0.8 |
| Water | 73.4 |

* * * * *